US008677564B2

(12) United States Patent
Pelekanos

(10) Patent No.: US 8,677,564 B2
(45) Date of Patent: Mar. 25, 2014

(54) BOGEY ASSEMBLY

(75) Inventor: Stylianos Pelekanos, New South Wales (AU)

(73) Assignee: RMD Industries Pty Ltd, Regents Park, NSW (AU)

( * ) Notice: Subject to any disclaimer, the term of this patent is extended or adjusted under 35 U.S.C. 154(b) by 0 days.

(21) Appl. No.: 13/388,252

(22) PCT Filed: Jul. 29, 2010

(86) PCT No.: PCT/AU2010/000963

§ 371 (c)(1),
(2), (4) Date: Apr. 3, 2012

(87) PCT Pub. No.: WO2011/011832

PCT Pub. Date: Feb. 3, 2011

(65) Prior Publication Data

US 2012/0186046 A1 Jul. 26, 2012

(30) Foreign Application Priority Data

Jul. 31, 2009 (AU) ..... 2009903608
Dec. 23, 2009 (AU) ..... 2009251170
Dec. 23, 2009 (AU) ..... 2009906264

(51) Int. Cl.
*E05D 15/16* (2006.01)

(52) U.S. Cl.
USPC ..... 16/98; 16/97; 16/87 R; 16/91; 16/105; 16/106

(58) Field of Classification Search
USPC ..... 16/90, 91, 94 R, 96 R, 95 R, 97, 16/101–107, 87 R, 84 R, 87.6 R, 87.8, 273; 160/185, 199; 49/404, 409, 410, 411, 49/412, 420, 421–425, 453, 455
See application file for complete search history.

(56) References Cited

U.S. PATENT DOCUMENTS

| | | | | |
|---|---|---|---|---|
| 1,931,796 | A | 10/1933 | Hoffman | |
| 2,957,197 | A * | 10/1960 | Johnson, Jr. | 16/105 |
| 3,757,384 | A * | 9/1973 | Rusch | 16/97 |
| 3,829,929 | A * | 8/1974 | Foltz et al. | 16/97 |
| 5,035,025 | A * | 7/1991 | Morris et al. | 16/97 |
| 6,209,171 | B1 * | 4/2001 | Pelletier et al. | 16/97 |
| 6,463,625 | B2 * | 10/2002 | Mittag | 16/97 |
| 6,618,900 | B2 | 9/2003 | Spork et al. | |
| 6,983,512 | B2 * | 1/2006 | De Oliveira | 16/97 |
| 7,117,559 | B1 * | 10/2006 | Barber | 16/97 |
| 2010/0205772 | A1 * | 8/2010 | Haab et al. | 16/91 |

FOREIGN PATENT DOCUMENTS

| | | | |
|---|---|---|---|
| GB | 1405931 | A | 9/1975 |
| JP | 2007-315106 | A | 12/2007 |
| JP | 2008-169686 | A | 7/2008 |
| JP | 133060 | A | 6/2009 |

* cited by examiner

*Primary Examiner* — Chuck Mah
(74) *Attorney, Agent, or Firm* — Kilpatrick Townsend & Stockton LLP

(57) ABSTRACT

A bogey assembly (1) for supporting a hanger bolt, the bogey assembly (1) including a body (2) for supporting the hanger bolt when in use and a lock mechanism (32) operatively mounted to the body (2), the lock mechanism being operable so as to be able to adopt a locked condition, where the hanger bolt is restricted from movement relative the body (2), and a unlocked condition where the hanger bolt can be moved relative to the body (32).

7 Claims, 16 Drawing Sheets

BOGEY ASSEMBLY

FIELD OF THE INVENTION

The present invention relates to a bogey particularly but not exclusively for carrying a hanger bolt for supporting a folding panel such as a door panel.

BACKGROUND OF THE INVENTION

A known form of bogey includes a body with a pair of wheels at either end, on fixed wheel axles. The bogey carries a hanger bolt or the like, which is mounted perpendicularly to the body by being screw threaded into the body. The hanger bolt in turn supports a hinge which is attached to a folding panel such as a door or window panel.

The bogey is designed to travel in an overhead track and strict tolerances between the wheels and the track need to be satisfied in order to avoid wear or fatigue of component parts as the bogey passes along the track and variable moment forces are applied to the wheels and hanger bolt, as the panel moves between an open and a closed condition.

Height adjustment of the hanger bolt relative to bogey is required to hang a hinge for a folding door or panel at a correct height relative to an overhead track. A head of the hanger bolt supports a hinge leaf, which in turn carries the folding door, and a shank of the hanger bolt is screw threaded into and out of the body of the bogey to achieve the required height adjustment of the hanger bolt and supporting hinge.

A lock nut, mounted on the threaded shank of the hanger bolt, has previously been used to lock the hanger bolt against the body of the bogey, in order to prevent further vertical movement once the correct height has been achieved. However, over time and multiple door folds, a lock nut can loosen and cause the door to drop.

Another mechanism for fixing the height of the hinge is to lock the hinge leaf to the hanger bolt head. This may be achieved using a spring biased tab in the head of the hanger bolt to releasable lock into a slot formed in the hinge leaf. However, the machining of such a mechanism is non-trivial and any further adjustment is difficult as the tab needs to be held in a retracted condition during adjustment. Importantly though, repeated rotation of the hanger bolt in the body of the bogey as the door is opened and closed, may wear the thread.

SUMMARY OF THE INVENTION

In accordance with an aspect of the invention there is provided, a bogey assembly for supporting a hanger bolt, the bogey assembly including a body for supporting the hanger bolt when in use and a lock mechanism operatively mounted to the body, the lock mechanism being operable so as to be able to adopt a locked condition, where the hanger bolt is restricted from movement relative the body, and a unlocked condition where the hanger bolt can be moved relative to the body.

Preferably, when the lock mechanism is in the locked condition the hanger bolt is restricted from rotational movement relative to the body.

Preferably, the hanger bolt is an elongate member having a longitudinally extending axis wherein, when the lock mechanism is in the locked condition the hanger bolt is restricted from movement in the direction of the longitudinal axis thereof relative the body.

Preferably, the lock mechanism includes a keeper which is moveable between a free position, in which the lock mechanism is in the unlocked condition, and an engaged position, in which the lock mechanism is in the locked condition.

Preferably, the keeper is slidable between the free position and the engaged condition.

Preferably, the hanger bolt includes side flats, the keeper being arranged to engage the side flats when in the engaged condition and the lock mechanism is in the locked condition.

Preferably, the keeper slides laterally of the hanger bolt to engage the side flats.

Preferably, the hanger bolt includes a collar associated therewith and the keeper is arranged to restrict movement of the collar when in the engaged position.

Preferably, the collar includes a throat which is profiled to key with side flats of the hanger bolt and an external profile to engage with the keeper to prevent rotation of the hanger bolt when in the engaged position.

Preferably, the keeper is retained in the engaged position under bias.

Preferably, the lock mechanism includes an actuator button to move the keeper between the free and the engaged positions.

Preferably, the lock mechanism has a cover plate to capture the keeper against the body, arranged whereby the button is accessible through the cover plate.

Preferably, the lock mechanism is recessed into the body.

In accordance with another aspect of the invention there is provided, a bogey assembly for supporting a hanger bolt when in use, the bogey assembly including a body through which a retainer mounted, the retainer being internally threaded for engagement with a corresponding thread on the hanger bolt and wherein the retainer is able to pivot relative the body of the bogey so that the hanger bolt is able to swing relative to the body of the bogey.

Preferably, the retainer is arranged to extend substantially horizontally in a transverse direction relative to a direction of travel of the bogey assembly.

Preferably, the retainer is in the form of an axle.

Preferably, the bogey assembly further including an arm supporting two laterally spaced rollers, the arm being coupled to a pivot located at a first end of the body so as to rotate about an axis oriented toward a direction of travel of the bogey assembly.

Preferably, the retainer is provided toward a second end of the body and the bogey further includes side wheels, to support the body intermediate the first and second ends.

Preferably, the bogey assembly further includes a guide element located on top of the body for receipt in a track through which the bogey assembly travels, the element being arranged to guide the bogey assembly during travel along the track.

Preferably, in use, a load applied to the hanger bolt urges the side wheels towards a lower portion a track through which the bogey assembly travels and urges the two laterally spaced rollers towards an upper portion a track through which the bogey travels, the hanger bolt being able to pivot about the retainer to maintain a vertical alignment.

In accordance with yet another aspect of the invention there is provided, a bogey assembly including a body with an arm supporting two laterally spaced rollers, the arm being coupled to a pivot located on the body so as to rotate about an axis oriented toward a direction of travel of the bogey assembly.

Preferably, wherein the arm is formed of two lateral sections which extend from a central bearing mounted to the pivot.

Preferably, the pivot comprises an axle which projects from a first end of the bogey assembly.

Preferably, the bogey assembly further includes a lock mechanism housed by the body, the lock mechanism being operable so as to be able to adopt a locked condition, where the hanger bolt is restricted from movement relative the body, and an unlocked condition where the hanger bolt can be moved relative to the body.

Preferably, the body includes a bore through which the hanger bolt passes to connect with the retainer and the lock mechanism is located adjacent the bore to engage the hanger bolt when in the locked condition.

Preferably, the lock mechanism includes a keeper which is moveable between a free position, in which the lock mechanism is in the unlocked condition, and an engaged position in which the lock mechanism is in the locked condition.

Preferably, in the free position the hanger bolt is free to rotate for adjustment in or out of the retainer, and the engaged position the hanger bolt is restricted in rotation about its elongate axis.

Preferably, in the engaged position the hanger bolt is able to pivot about the retainer.

BRIEF DESCRIPTION OF THE DRAWINGS

The invention is described in more detail, by way of non-limiting example only, with reference to the accompanying drawings, in which.

DETAILED DESCRIPTION OF THE DRAWINGS

Figure 1:
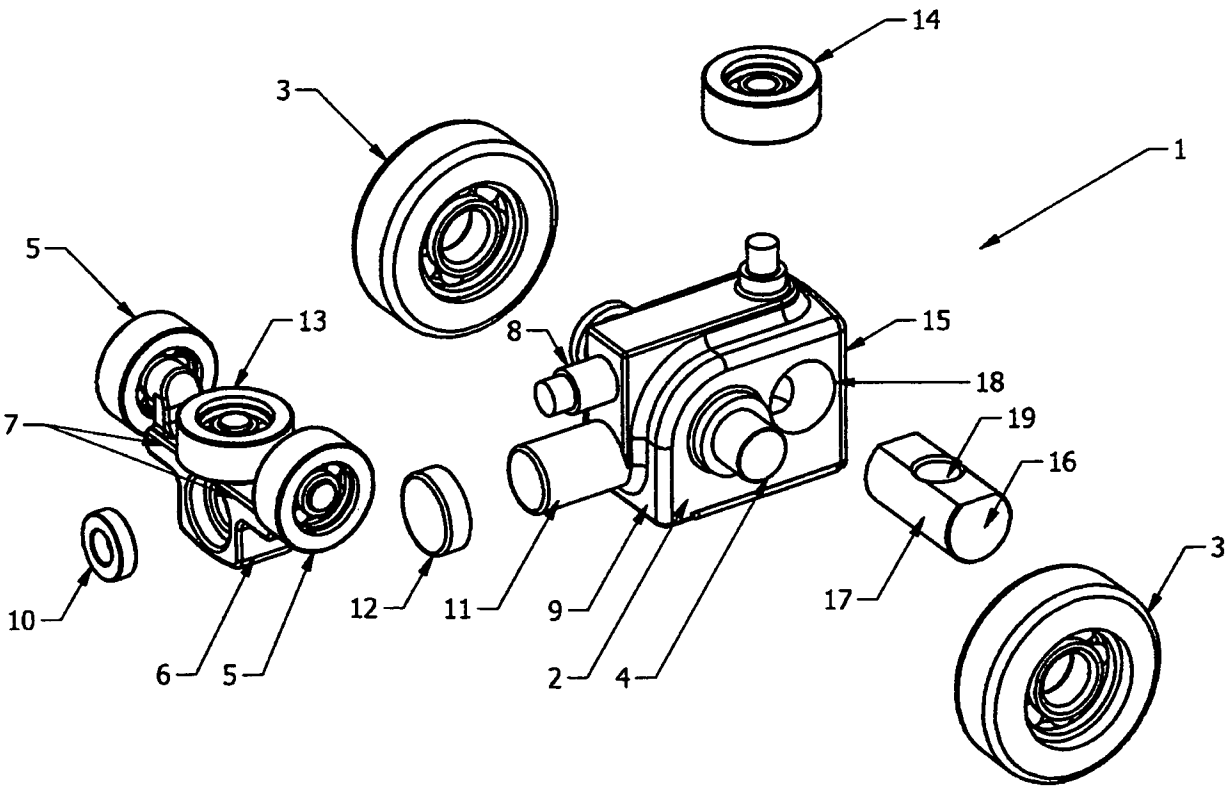
FIG. 1 is an exploded view of a bogey assembly.

Referring firstly to FIG. 1, a first example of a bogey assembly 1 is shown as including a body 2, two main wheels 3 mounted on respective axles 4 and two smaller rollers 5 carried by a pivot arm assembly 6.

The pivot arm assembly 6 is formed of two lateral sections 7 which extend from a central bearing, which is mounted to a pivot in the form of an axle 8 that projects from a first end 9 of the body 2. The assembly 6 is secured to the body 2 in place using a washer 10, which is riveted in place.

A boss 11 is provided on the body 2, beneath the pivot arm assembly 6 and is fitted with a rubber buffer 12. The boss 11 and buffer 12 serve as an end of travel stop for the bogey assembly 1.

The assembly 6 also has a top mounted guide roller 13, which is in alignment with a second guide roller 14 mounted toward a second end 15 of the body 2.

The second end 15 of the bogey assembly 1 also houses a retainer 16, which is in the form of a pivotal member or axle 17 that extends through a substantially horizontal passage 18 provided in the body 2, arranged transverse to a direction of travel of the bogey assembly 1.

Figure 2:
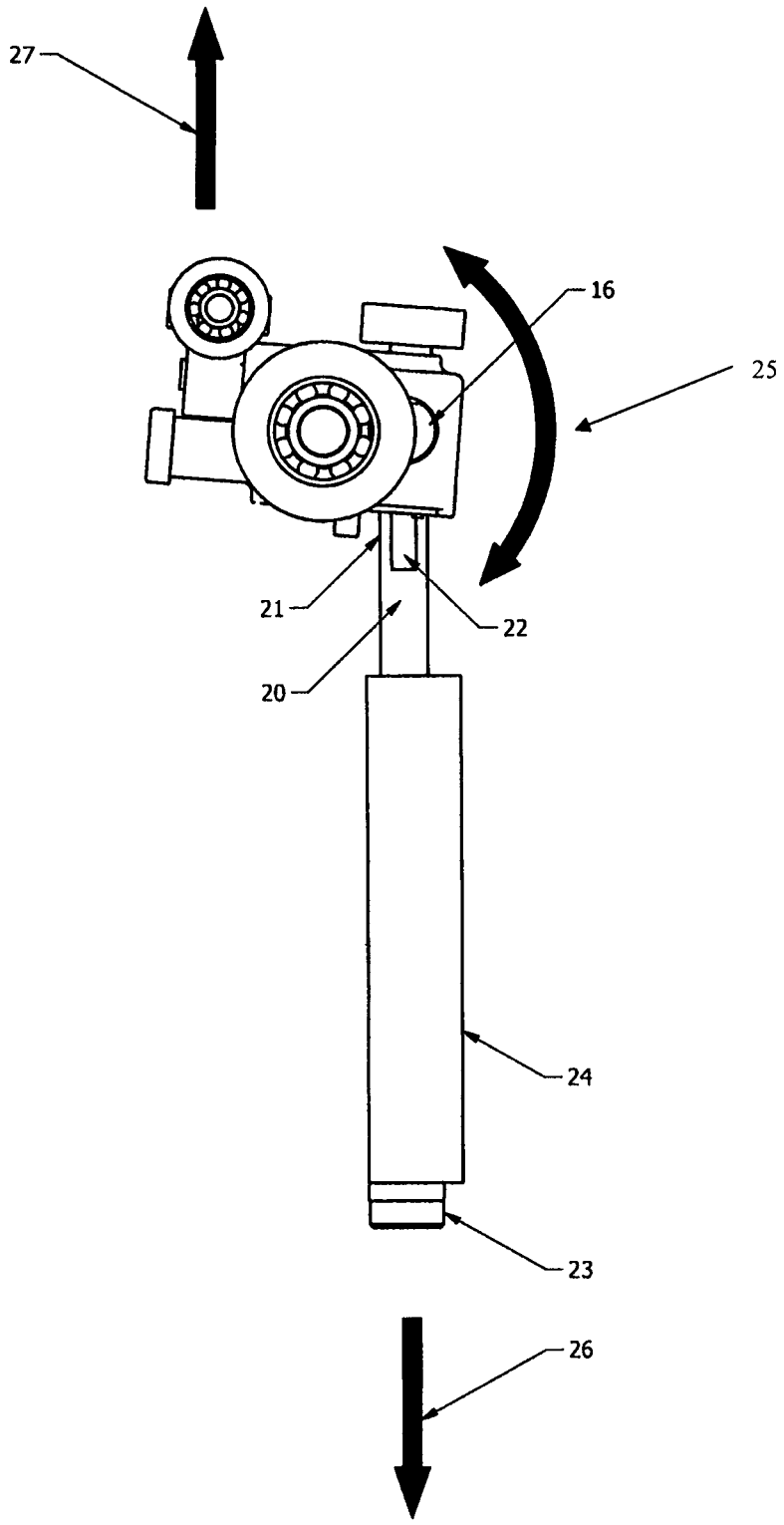
FIG. 2 is a side view of the bogey assembly with a hanger bolt.

The retainer 16 includes an internal thread 19 for threaded engagement with a hanger bolt 20, which is illustrated in FIG. 2.

The hanger bolt 20 is shown as including a threaded shaft 21 with side flats 22 and a bolt head 23, which supports a hinge 24. In order to mount the shaft in the bogey assembly 1, the threaded shaft 21 is engaged with the internal thread 19 and rotated into the retainer 16 until the hanger bolt 20 is at a desired height.

Once the hanger bolt 20 is mounted in the bogey assembly 1, the hanger bolt 20 can pivot about the retainer 16 in a direction indicated by arrows 25. This serves to substantially reduce moments that might have otherwise applied through the hanger bolt 20 if, for example, the hanger bolt 20 had a fixed connection with the bogey assembly 1.

Figure 3:
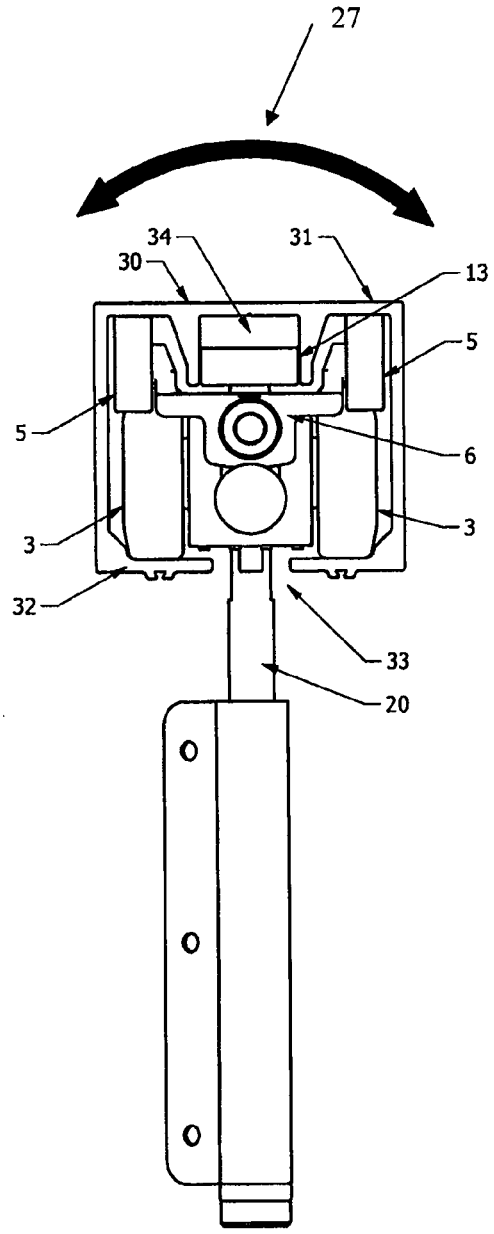
FIG. 3 is an end view of the bogey assembly in a track.
Figure 4:
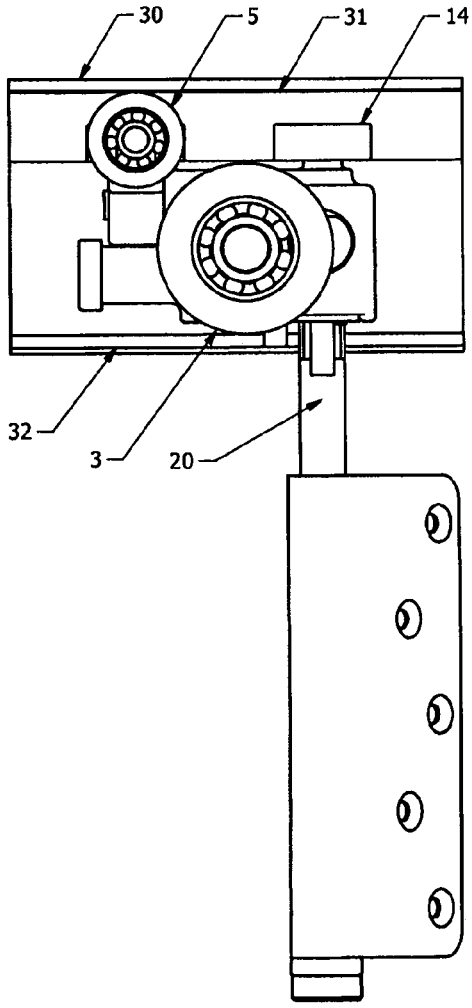
FIG. 4 is a diagrammatic side view of the bogey assembly in the track.

The positioning of the retainer 16 toward the second end 15 of the bogey assembly 1 also means any weight load force applied to the hanger bolt 20, such as from a supported door panel or the like (as indicated by arrow 26) is transferred to the rollers 5 through pivot action of the body 2 (as indicated by arrow 27) so that the rollers maintain contact with a track 30, as illustrated in FIGS. 3 and 4.

More particularly, FIGS. 3 and 4 show the track 30 as including a top rail section 30A and a lower rail section 30B with a slot 30C to allow passage of the hanger bolt 20 suspended from the bogey assembly 1. The top rail section 30A also includes a central channel 30D to receive the guiding rollers 13, 14.

As may be appreciated, any downward movement on the hanger bolt 20 will cause the main wheels 3 to firmly engage the lower rail section 30B but will also cause the rollers 5 to be loaded against the top rail section 30A via the pivot arm assembly 6. The hanger bolt 20 is able to pivot about the retainer 16 to maintain a generally vertical orientation.

The pivot arm assembly 6 and its associated axle 8 thereby represents a live axle of the bogey assembly 1 in the sense the pivot arm assembly 6 rotates about a substantially horizontal axis, oriented in a direction of travel of the bogey assembly 1, to ensure the rollers 5 split the load equally. On the contrary, the prior art fixed axle arrangement requires total precision to safeguard against uneven load distribution and wear.

A second live axle is provided by the retainer 16, which supports the hanger bolt 20. In that case, the axle 17 also compensates for inaccuracy in the bogey assembly 1. For example, if the rollers 5 are cast too low, the load down the hanger bolt 20 will not be perfectly perpendicular to the bogey assembly 1, which would normally create large bending moments in the hanger bolt 20 and possible fatigue and fracture. The live axle 17, however, compensates and automatically adjusts by allowing the retainer 16 to pivot so that the load passes through the hanger bolt 20 without bending. This will, of course, mean the hanger bolt 20 will move fractionally during use but any variation can be taken up by the height adjustment built into the design.

Pivotal movement of the hanger bolt 20 relative to the bogey assembly 1 does, however, present a problem in relation to locking the hanger bolt 20 at a selected height, to prevent the hanger bolt 20 unscrewing from the body 2 over time. A conventional lock-nut to lock the hanger bolt 20 to the body 2 is clearly inappropriate as the pivotal movement of the hanger bolt 20 would be restricted as a result. To address this problem, the bogey assembly 1 is provided with a lock mechanism 32, as shown in FIGS. 5 to 12.

Figure 5:
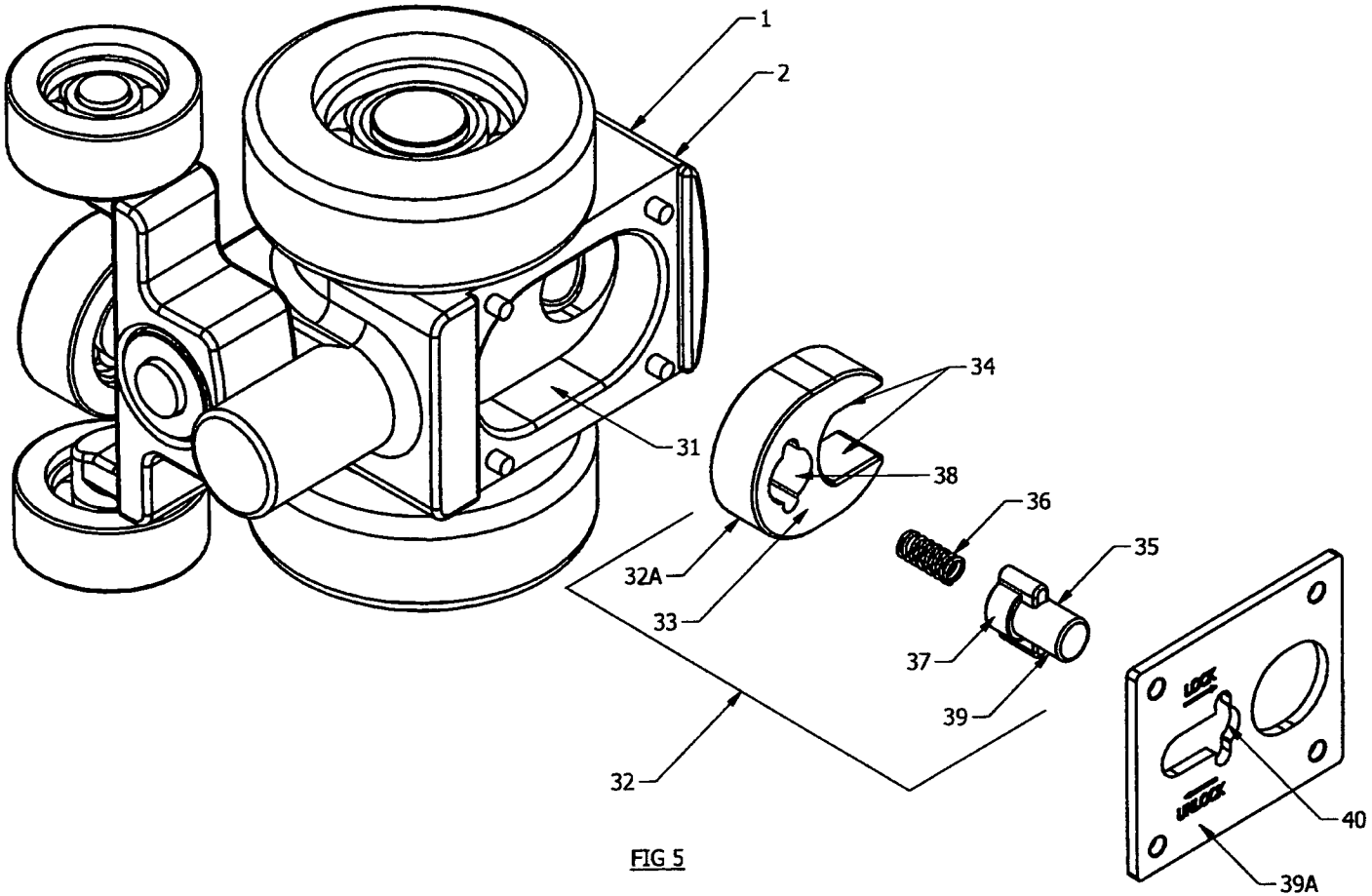
FIG. 5 is a perspective view of the bogey assembly with an exploded view of a lock mechanism.

Referring firstly to FIG. 5, the body 2 of the bogey assembly 1 is recessed to provide a housing 31 for the lock mechanism 32. The lock mechanism 32 is configured be movable between a locked condition, where the hanger bolt 20 is restrict from rotation about its elongate axis, and an unlocked condition where the hanger bolt 20 may be rotated about its elongate axis. The lock mechanism 32 includes a keeper 32A which is arranged to move between an engaged and a free position, the engaged position providing the locked condition and the free position providing the unlocked condition.

The keeper 32A is formed as a U-shaped block 33, with flat surfaces 34 confined to fit with flats 22 of the hanger bolt 20. Accordingly, in the engaged condition the flat surfaces 34 of the U-shaped block 33 directly engage with the flats 22 of the hanger bolt 20. The U-shaped block 33 provides a slightly elongate housing for the hanger bolt 20 and as such when the keeper 32A is in the engaged position, the U-shaped block 33 restricts the hanger bolt 20 from rotation about its elongate axis but allows the hanger bolt 20 limited movement in the direction of travel of the bogey assembly 1 by pivoting about the retainer 16. During this pivoting it may be appreciated that there will be some limited sliding movement between the flats 22 of the hanger bolt 20 and the flat surfaces 34 of the U-shaped block 33.

The lock mechanism 32 also has an actuating button 35 which is biased by a spring 36 and which needs to be depressed in order to move the keeper 32A out of engagement with the hanger bolt 20. The button 35 has a base 37, received in a bore 38 of the block 33 and a neck 39 which passes through a guide slot, formed in cover plate 39A.

Figure 6:
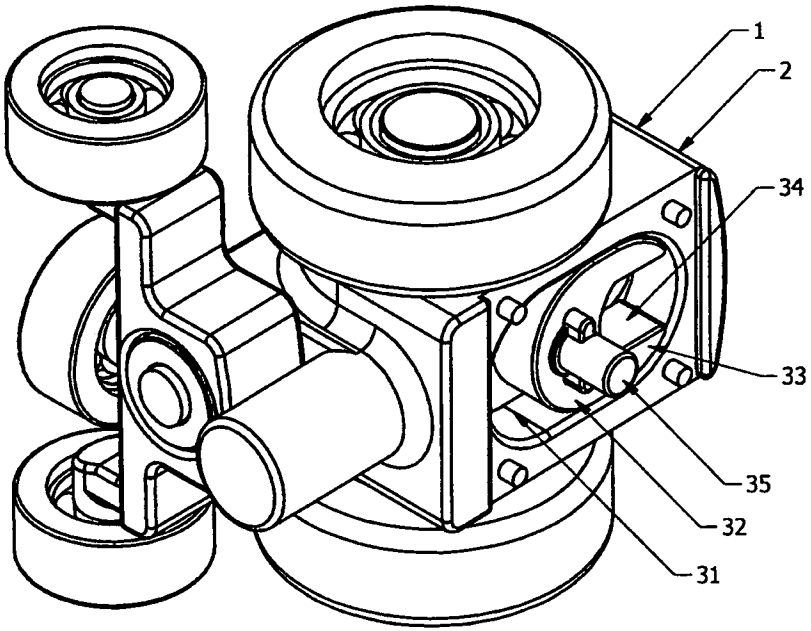
FIG. 6 is a perspective view of the lock mechanism housed within a body of the bogey.

When the keeper 32A is in the engaged position where the lock mechanism 32 is in the locked condition, as illustrated in FIG. 6, the button 35 is spring biased to project through an enlarged aperture 40 in the cover plate 39A.

Figure 7:
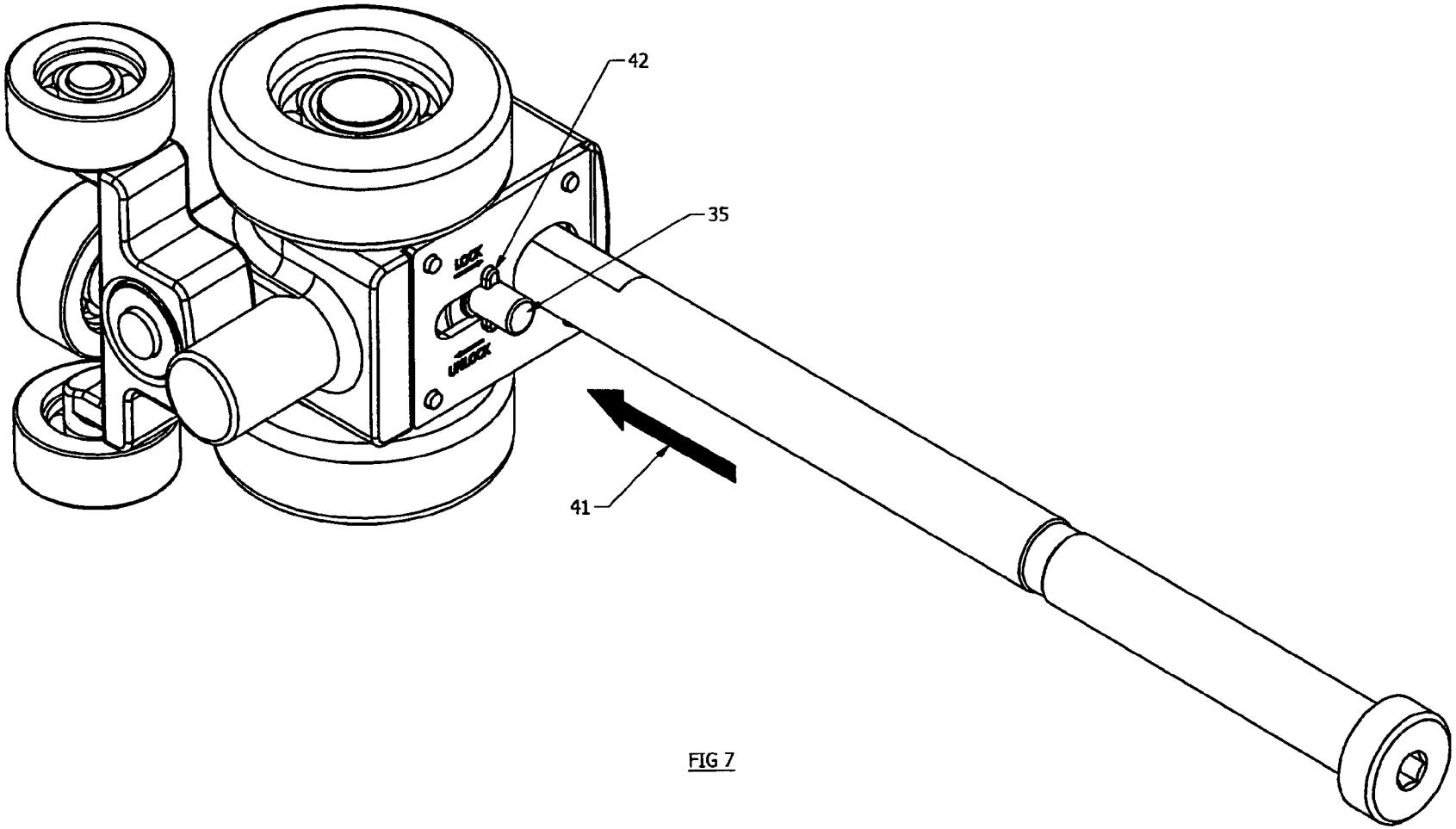
FIG. 7 is a perspective view of the bogey assembly and hanger bolt.
Figure 8:
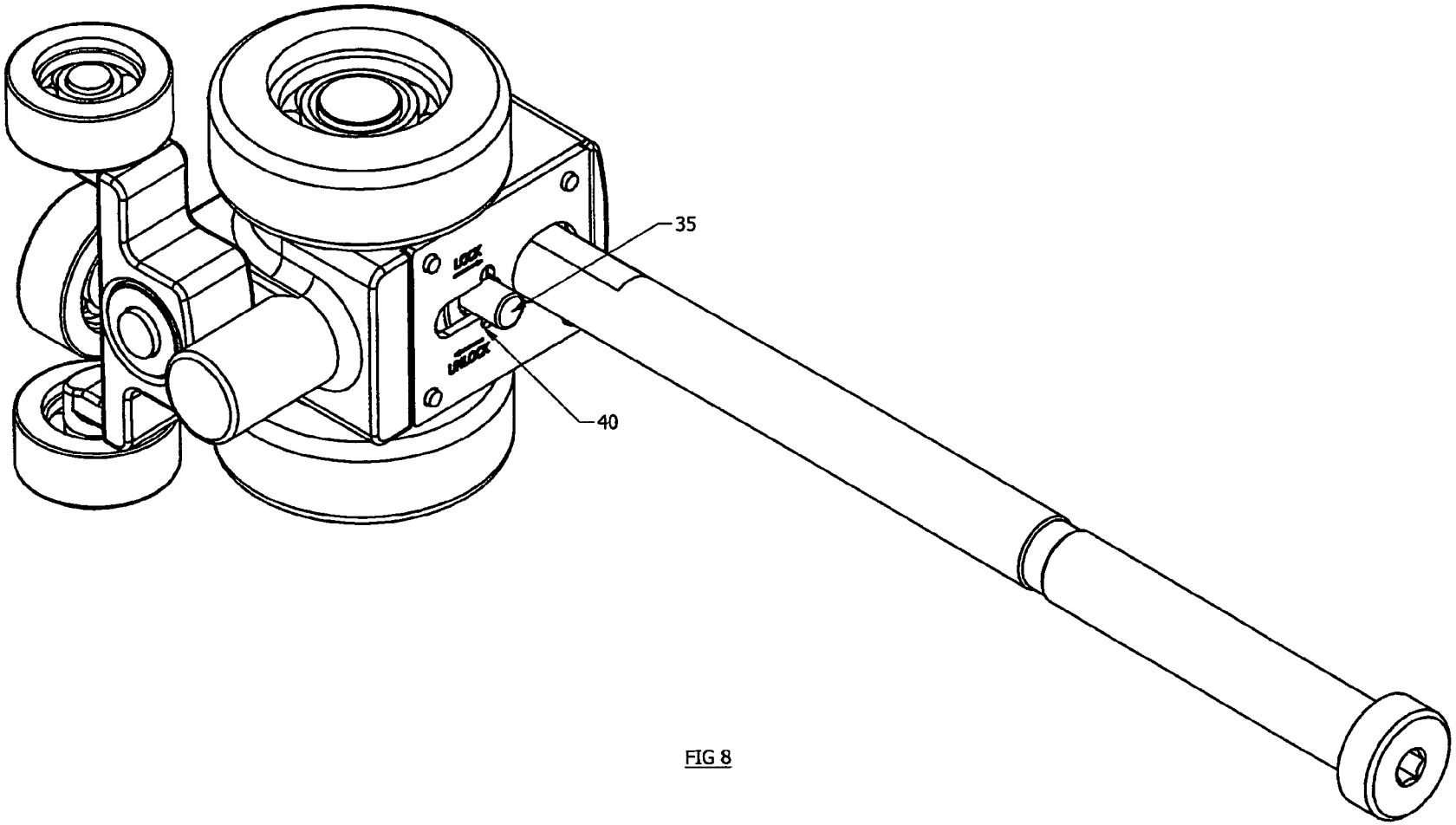
FIG. 8 illustrates the lock mechanism being freed for adjustment.

To release the lock mechanism 32, the button 35 needs to firstly be pressed in a direction indicated by arrow 41 in FIG. 7, until shoulders 42 of the button clear the aperture 40, as illustrated in FIG. 8.

Figure 9:
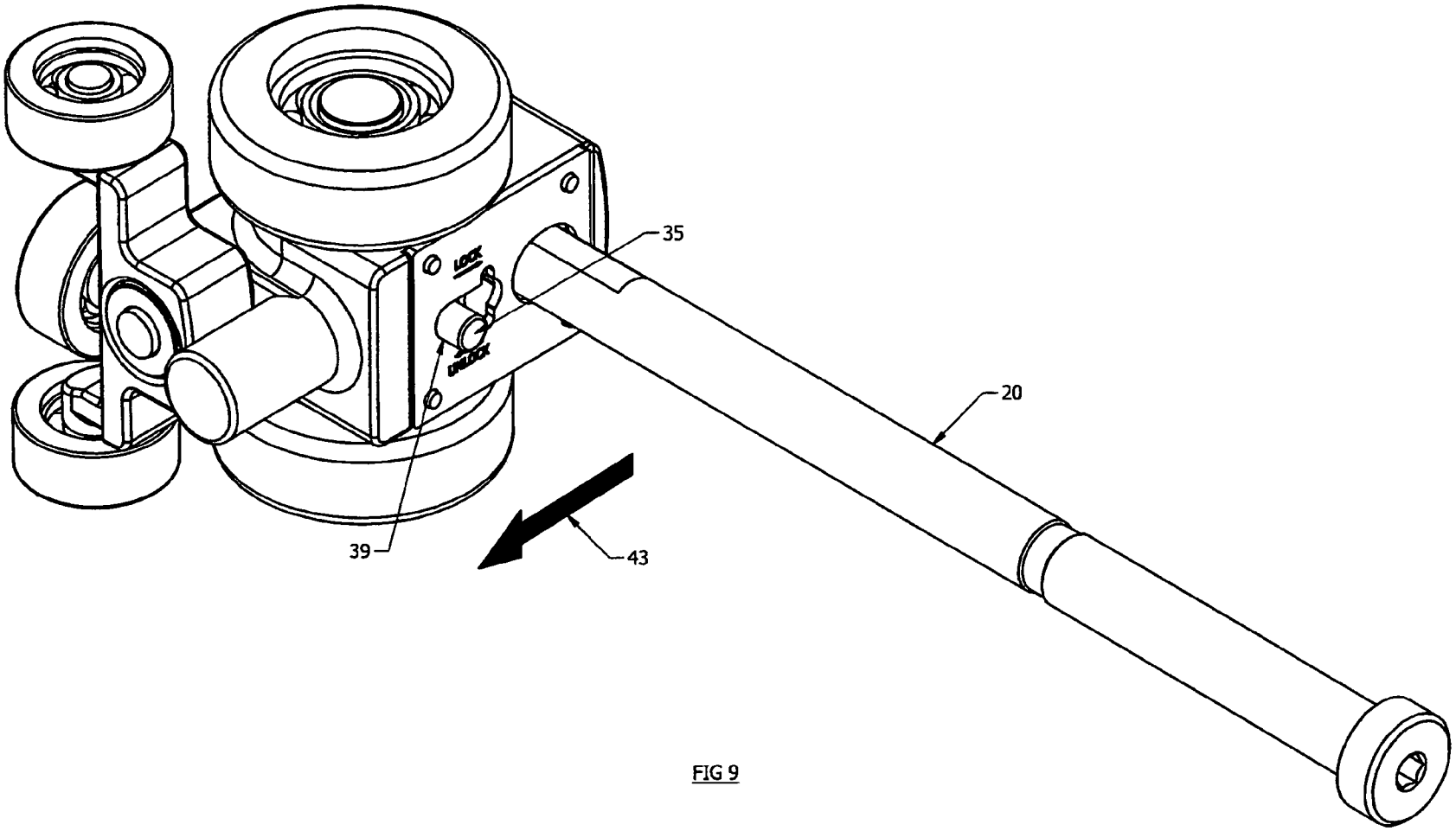
FIG. 9 illustrates the lock mechanism in an unlocked condition.

The button 35 is then slid in a direction indicated by arrow 43, as shown in FIG. 9, so that the neck 39 of the button 35 travels along the slot, which draws the keeper 32A out of engagement with the hanger bolt 20 so as to provide the free position where the lock mechanism 32 is in the unlocked condition.

Figure 10:
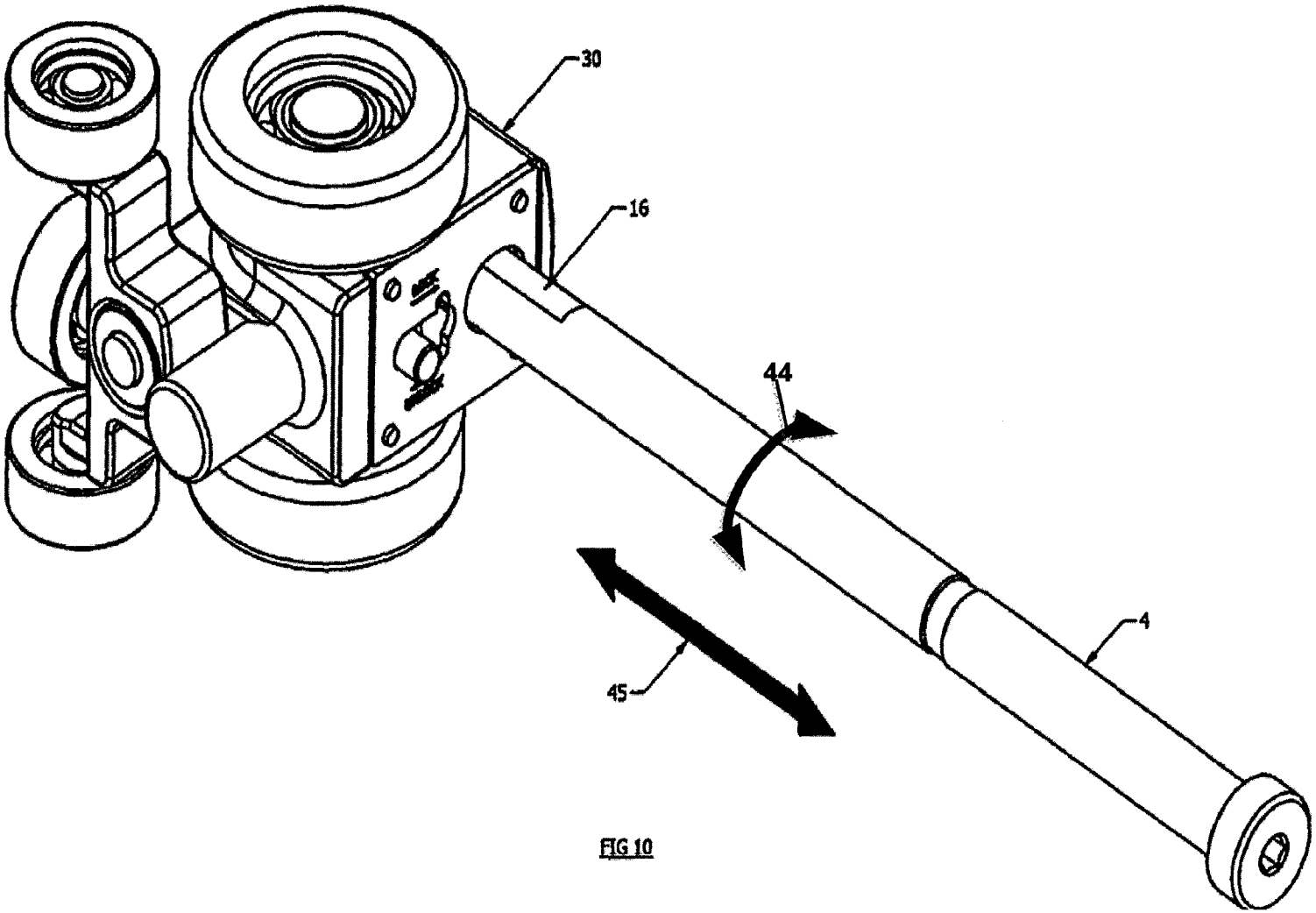
FIG. 10 illustrates adjustment of the hanger bolt.

The hanger bolt 20 may then be rotated in a direction indicated by arrows 44 in FIG. 10, to effect screw threaded axial movement in the directions indicated by arrows 45, into and out of the retainer 16 and hence the bogey assembly 1, as required.

Figure 11:
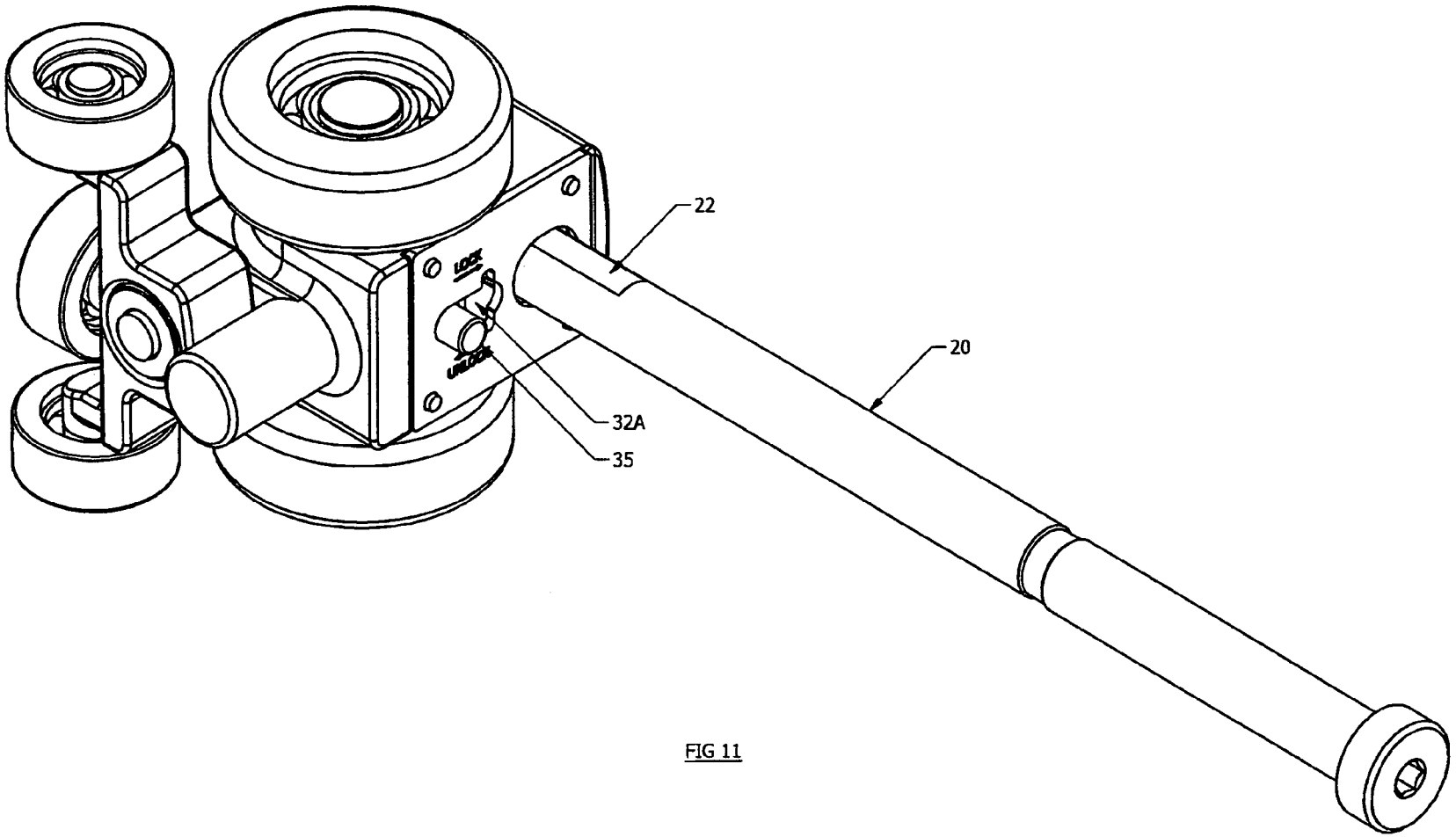
FIG. 11 is a perspective view of the position of the hanger bolt prior to locking.
Figure 12:
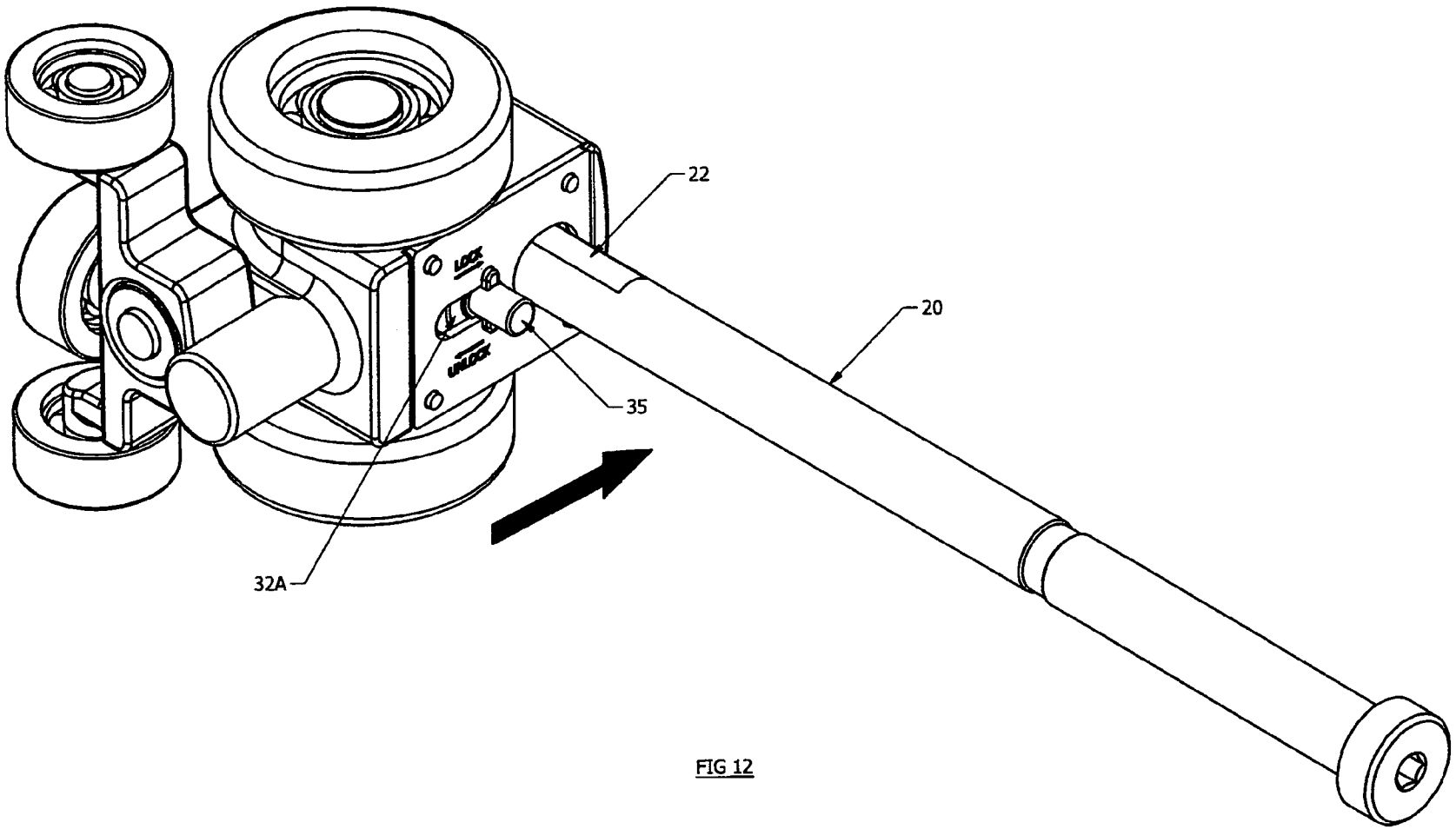
FIG. 12 is illustrates the lock mechanism being re-engaged.

When the correct adjustment has been made the hanger bolt 20 is rotated slightly so that the flats 22 are aligned with the surfaces 34 of the keeper 32A as illustrated in FIG. 11. From that position, the button 35 is slid back to the original position, as shown in FIG. 12, so that the keeper 32A engages the flats 22 to secure the hanger bolt 20 against any further rotation relative to the bogey assembly 1.

Figure 13:
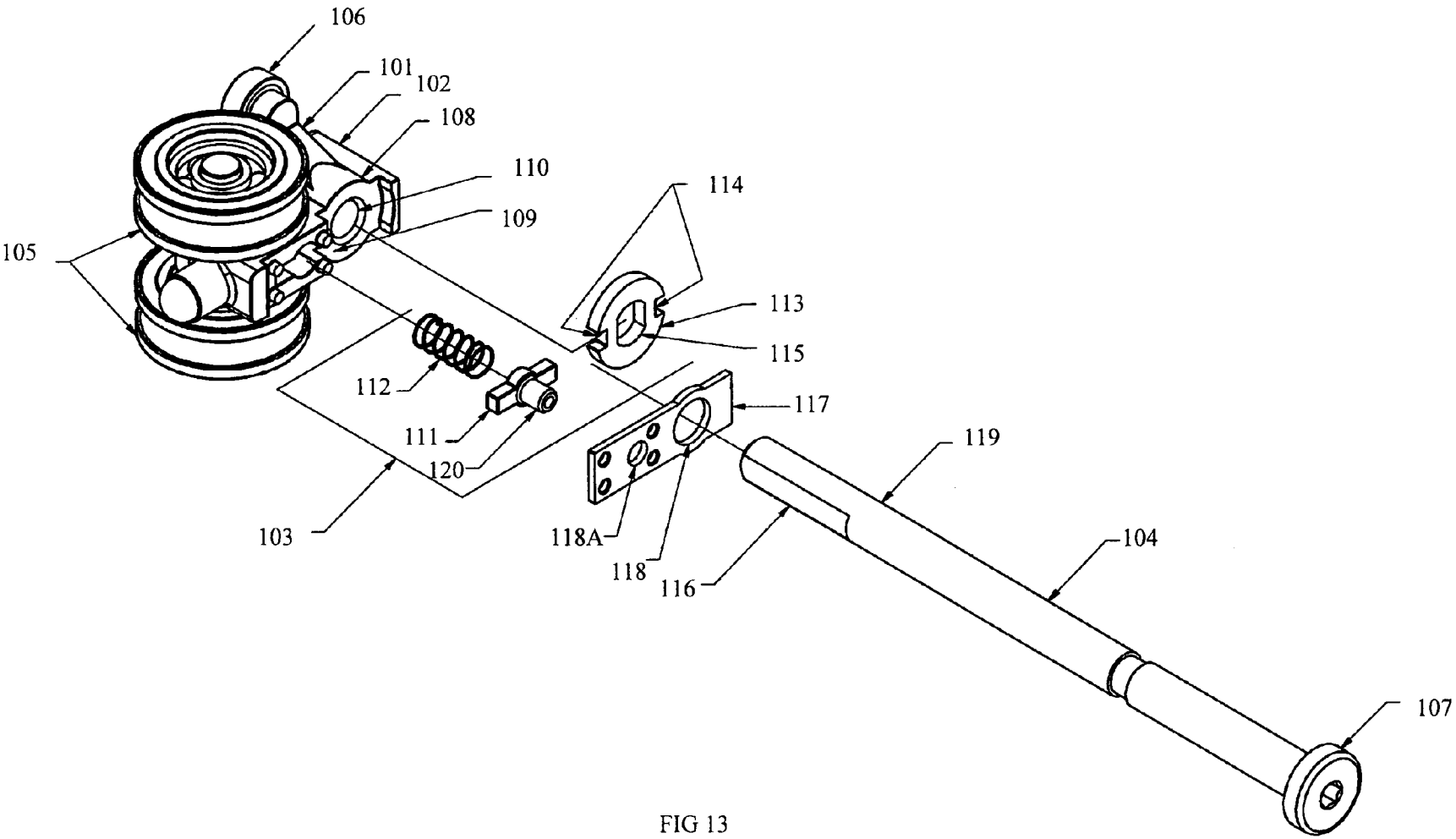
FIG. 13 is an exploded perspective view of another example of a bogey assembly and hanger bolt.

Another example of a bogey assembly 101 is shown in FIGS. 13 to 17. Referring to FIG. 13 the bogey assembly 101 is shown as including a body 102 with a lock mechanism 103 arranged to engage a hanger bolt 104.

The body 102 is provided with wheels 105 and rollers 106 for guiding the assembly in an overhead track (not shown) and the lock mechanism 103 serves to fix the hanger bolt 104 in the bogey assembly 101 to thereby lock the bolt head 107 and supported door panel at an appropriate height relative to the track.

The body 102 is formed from a casting 108 which provides housing 109 for the lock mechanism 103. The body 102 also includes a bore 110 for receiving the hanger bolt 104.

The lock mechanism 103 includes a keeper 111 which is biased by a spring 112 into an engaged position with a locking collar 113. The locking collar 113 has an external profile with slots 114 which are engaged by the keeper 111 and an internal throat 115 profiled to engage flats 116 of the hanger bolt 104.

A cover plate 117 is provided to retain the components of the lock mechanism against the body 102. The cover plate 117 has an aperture 118 to receive a shaft 119 of the hanger bolt 104. The aperture 118 is aligned with the collar 113 so that, when the hanger bolt 104 is received in the bogey assembly 101, the flats 116 are appropriately aligned and fit within the throat 115.

The cover plate 117 also includes opening 118A, through which an actuator button 120 is accessible. The actuator button 120 is coupled to the keeper 111 and allows the keeper 111 to be moved between the engaged and free positions. When the button 120 is depressed and the 111 keeper is disengaged, the locking collar 113 is free to rotate relative to the body 102, which in turn means the hanger bolt 104 is free to rotate.

Accordingly, it may be appreciated the lock mechanism 103 provides a locked condition when the keeper 111 is the engaged condition and an unlocked condition when the keeper 111 is the free position.

Threaded engagement between an internal thread of the bore 110 and external thread on the shaft 119, causes the hanger bolt 104 to be moved in or out of the bogey assembly 101 as a result of such rotation, so as to provide height adjustment of the hanger bolt 104.

The keeper 111 is biased into the engaged position by the spring 12 so that when adjustment has been completed, the keeper 111 will automatically re-engage the collar 113, as soon as the flats 116 of the hanger bolt 104 are at right angles to the keeper 111, so that the keeper 111 can lock into one of the slots 114.

The operation of the lock mechanism 103 is now further described with reference to FIGS. 14 to 17.

Figure 14:
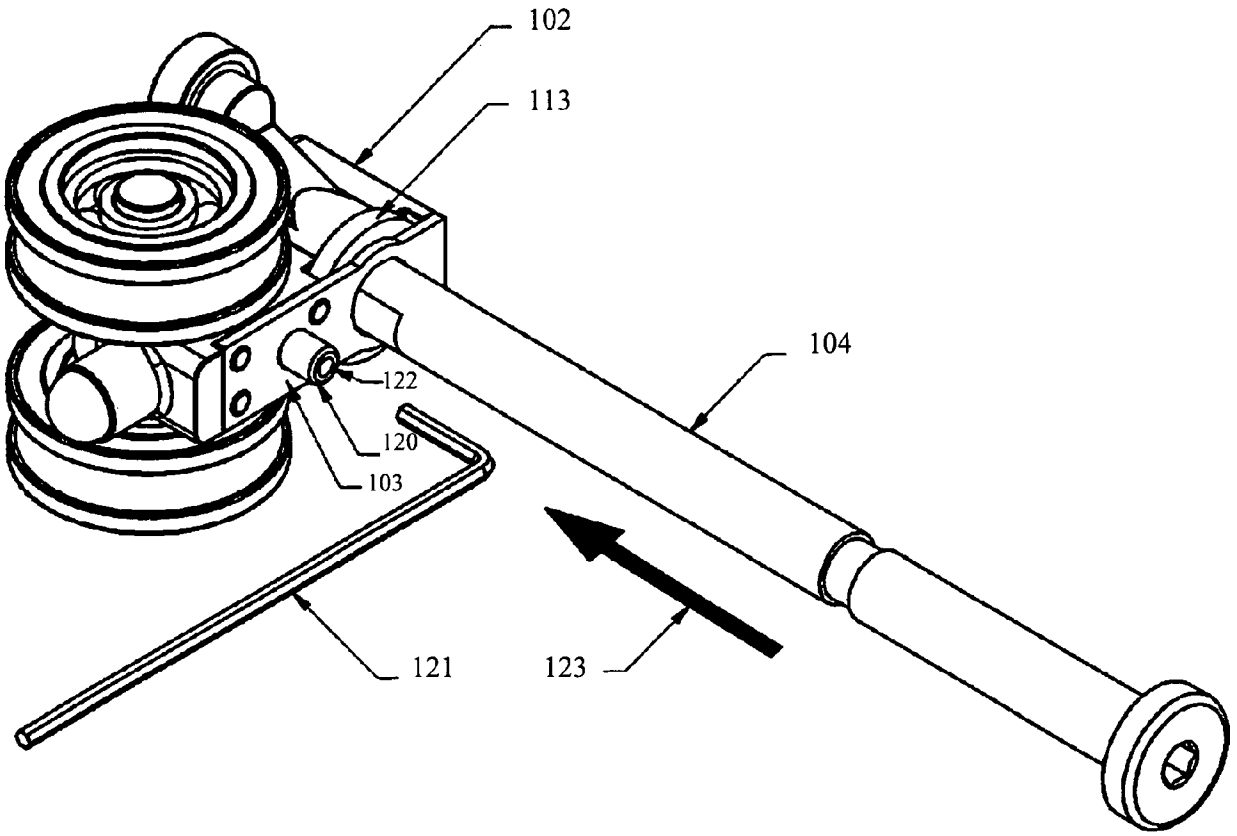
FIG. 14 is a perspective view of the bogey assembly and hanger bolt, in an assembled condition.

In FIG. 14, the lock mechanism 103 is in the locked condition, where the locking collar 113 is engaged by the keeper 111 and the hanger bolt 104 is locked against any rotation relative to the body 102 of the bogey assembly 101. In order to the free the hanger bolt 104 for rotation and height adjustment, the button 120 needs to firstly be depressed. This may be done by hand, using a finger or the like. Alternatively, a key 121 may be inserted in a recess 122 of the button, as illustrated, and pressed in a direction indicated by arrow 123.

Figure 15:
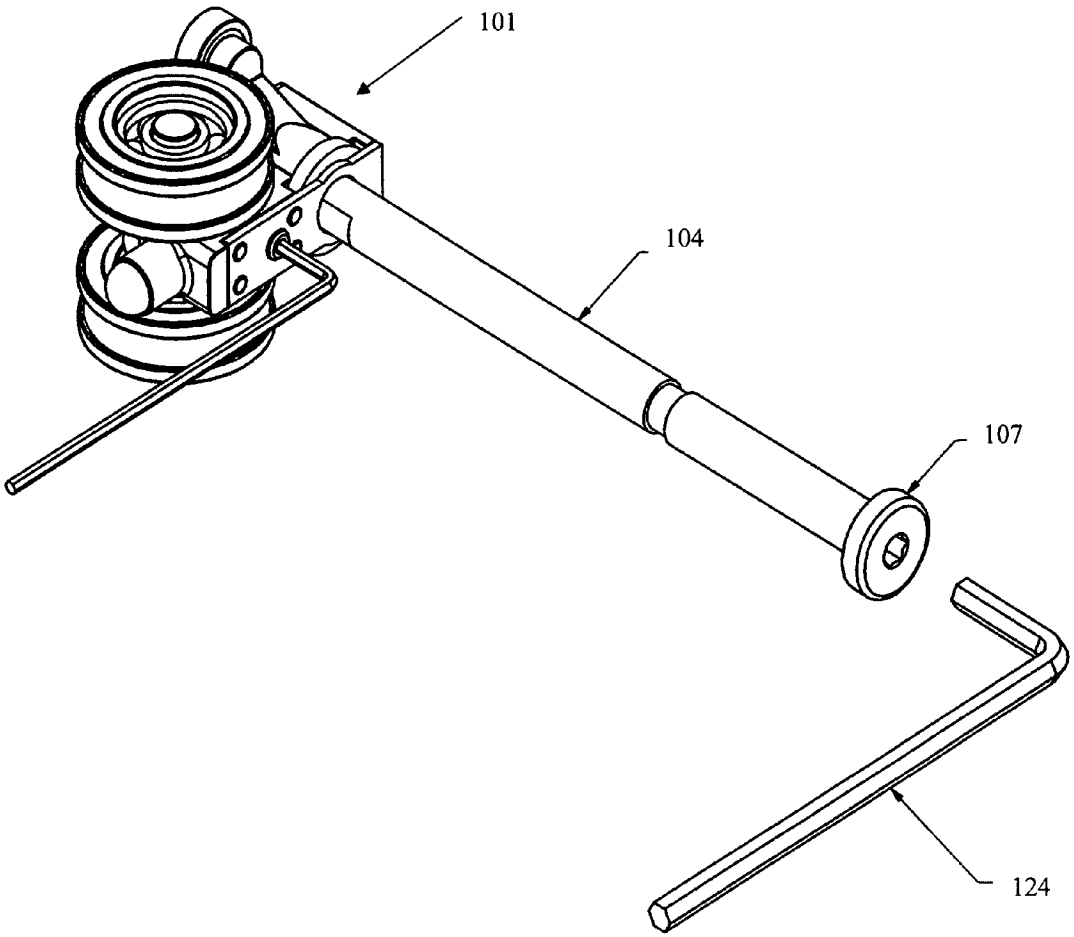
FIG. 15 illustrates a lock mechanism of the bogey assembly being freed for adjustment.

While the button 120 is pressed inwardly of the body 102, the hanger bolt 104 may be manually rotated for adjustment or a spanner key 124 can instead be inserted in the bolt head 107, as illustrated in FIG. 15.

Figure 16:
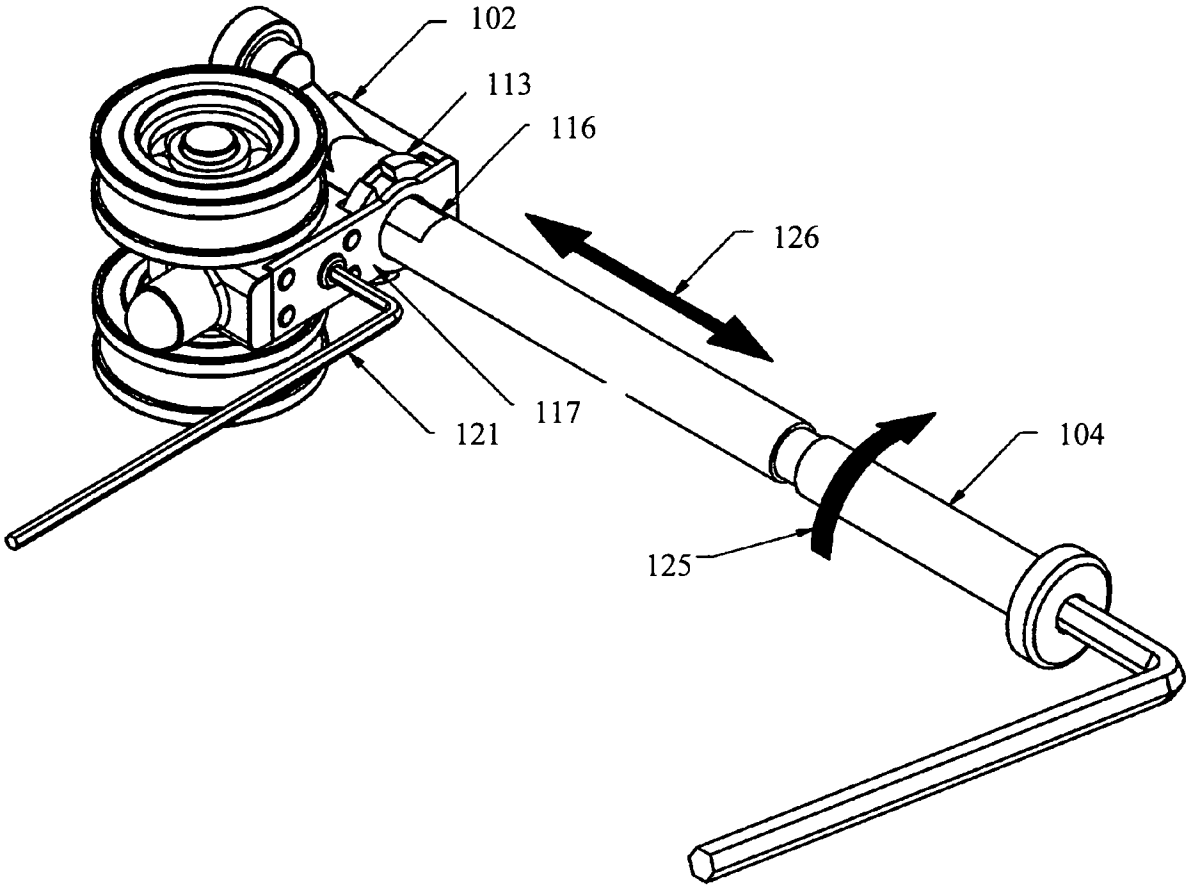
FIG. 16 illustrates adjustment of the hanger bolt.

Rotation of the hanger bolt 104, as indicated by arrow 125 in FIG. 16, will cause the hanger bolt 104 to move in an axial direction indicated by arrows 126. The axial movement of the hanger bolt 104 in and out of the body 102 adjusts the height of the door panel (not shown) supported by the bogey assembly 101. FIG. 16 also clearly shows the collar 113, which is captured between the body 102 and the cover plate 117, rotating in unison with the hanger bolt 104 since the flats 116 of the hanger bolt 104 are engaged with the inner profile of the throat 115.

Figure 17:
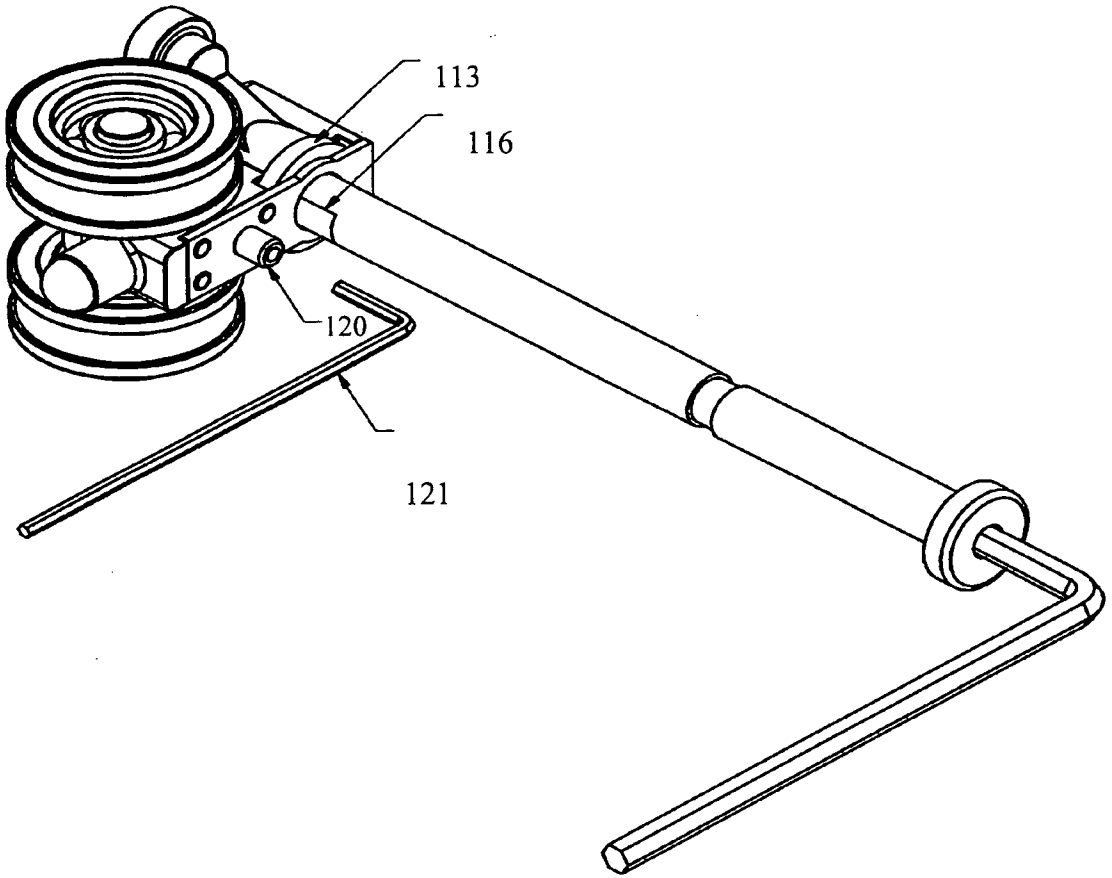
FIG. 17 illustrates the lock mechanism in an engaged condition

When the appropriate height adjustment is obtained, the key 121 is removed, as shown in FIG. 17, which releases the button 120 so that the keeper 111 re-engages the locking collar 113, when the flats 116 are at right angles and the slots 114 re-align with the keeper 111.

As may be appreciated from the above, the lock mechanisms 32, 103 provide a convenient and simple means to securely lock the hanger bolt 20, 104 after appropriate height adjustment relative to the bogey assembly 1, 101. The lock mechanisms 32, 103 have no free parts that might otherwise be dropped or lost and can be manually disengaged for further adjustment, if required, without the need for specialised tools. The mechanisms 32, 103 are also housed within the body 4, 102 of the bogey assemblies 1, 101, to minimise aesthetic impact. Since the body assemblies 1, 101 are themselves located within an overhead track during use the entire height adjustment and lock mechanism will also be hidden from view.

Many modifications will be apparent to those skilled in the art without departing from the scope of the present invention.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

LIST OF PARTS

1. Bogey assembly
2. Body
3. Wheels
4. Axles
5. Rollers
6. Pivot arm assembly
7. Lateral sections
8. Axle
9. First end
10. Washer
11. Boss
12. Buffer
13. Guide roller
14. Second guide roller
15. Second end
16. Retainer
17. Axle
18. Passage
19. Internal thread
20. Hanger bolt
21. Shaft
22. Side flats
23. Bolt head
24. Hinge
25. Arrows
26. Arrow
27. Arrow
30. Track
30A. Top rail section
30B. Bottom rail section
30C. Slot
30D. Channel
31. Housing
32. Lock mechanism
32A. Keeper
33. Block
34. Flat surfaces
35. Button
36. Spring
37. Base
38. Bore
39. Neck
39A. Cover plate
40. Aperture
41. Arrow
42. Shoulders
43. Arrow
44. Arrows
45. Arrows
101. Bogey assembly
102. Body
103. Lock mechanism
104. Hanger bolt
105. Wheels
106. Rollers
107. Bolt head
108. Casting
109. Housing
110. Bore
111. Keeper
112. Spring
113. Locking collar
114. Slots
115. Throat
116. Flats
117. Cover plate
118. Aperture
118A. Opening
119. Shaft
120. Actuator button
121. Key
122. Recess
123. Arrow
124. Spanner key
125. Arrow
126. Arrow

The invention claimed is:

1. A bogey assembly including a body with a bore for threaded engagement with a hanger bolt, and a lock mechanism to engage side flats of the hanger bolt and thereby lock the bolt against rotation and axial movement relative to the body, wherein the lock mechanism includes a collar arranged to fit onto the side flats of the bolt and rotate with the bolt during height adjustment obtained by rotating the bolt relative to the body, and wherein the lock mechanism further includes a keeper that is arranged to move from a free position into an engaged position with the collar, in order to lock the bolt against rotation relative to the body.

2. The bogey assembly of claim 1, wherein the collar has a throat adapted to key with the side flats of the hanger bolt, and a slotted profile into which the keeper is moved to engage and lock the collar against rotation.

3. The bogey assembly of claim 1, wherein the keeper is retained in the engaged position under bias.

4. The bogey assembly of claim 1, wherein the lock mechanism includes an actuator button to move the keeper between the free position and the engaged position.

5. The bogey assembly of claim 4, wherein the lock mechanism has a cover plate to capture the keeper in the body, and the button projects through the cover plate.

6. The bogey assembly of claim 1, wherein at least part of the lock mechanism is recessed into the body.

7. The bogey assembly of claim 1, including a hanger bolt with a thread to engage in the bore of the body and with side flats that are engaged by the collar of the lock mechanism to secure the bolt against rotation.

* * * * *